US006990915B2

(12) United States Patent
Smith

(10) Patent No.: US 6,990,915 B2
(45) Date of Patent: Jan. 31, 2006

(54) STABILIZED WATERCRAFT SUCH AS A TRIMARAN

(76) Inventor: Anthony Smith, 2512 Lion Dr., Annapolis, MD (US) 21403

( * ) Notice: Subject to any disclaimer, the term of this patent is extended or adjusted under 35 U.S.C. 154(b) by 141 days.

(21) Appl. No.: 10/913,597

(22) Filed: Aug. 9, 2004

(65) Prior Publication Data

US 2005/0034645 A1 Feb. 17, 2005

Related U.S. Application Data

(60) Provisional application No. 60/494,099, filed on Aug. 12, 2003.

(51) Int. Cl.
*B63B 1/00* (2006.01)

(52) U.S. Cl. ..... 114/61.16
(58) Field of Classification Search ..... 114/61.15, 114/61.16, 61.17
See application file for complete search history.

(56) References Cited

U.S. PATENT DOCUMENTS

| | | | | |
|---|---|---|---|---|
| 1,710,625 | A | | 4/1929 | Kapigian |
| 2,678,018 | A | | 5/1954 | Crisp |
| 2,759,201 | A | | 8/1956 | McKinney |
| 2,876,728 | A | | 3/1959 | Luger |
| 2,992,444 | A | | 7/1961 | Schuler |
| 3,839,979 | A | | 10/1974 | Wassell |
| 3,877,094 | A | * | 4/1975 | Kelley ..... 114/344 |
| 3,929,085 | A | | 12/1975 | Mason |
| 3,937,166 | A | | 2/1976 | Lindsay |
| 3,954,077 | A | | 5/1976 | Piat-Marchand |
| 3,960,102 | A | | 6/1976 | Davy |
| 3,978,536 | A | | 9/1976 | Howe |
| 3,981,259 | A | | 9/1976 | Harper, Jr. |
| 3,996,874 | A | * | 12/1976 | Winch ..... 114/61.16 |
| 4,159,006 | A | | 6/1979 | Thurston |
| 4,172,426 | A | | 10/1979 | Susman |
| 4,223,621 | A | | 9/1980 | Berger |
| 4,392,444 | A | | 7/1983 | Andersson |
| 4,457,248 | A | | 7/1984 | Thurston |
| 4,465,008 | A | | 8/1984 | Liggett |
| 4,474,128 | A | | 10/1984 | Wallach |
| 4,494,472 | A | * | 1/1985 | Rougerie ..... 114/66 |
| 4,718,368 | A | | 1/1988 | Ings |
| 4,730,570 | A | | 3/1988 | Harris |
| 4,878,447 | A | | 11/1989 | Thurston |
| 4,909,169 | A | | 3/1990 | Skandaliaris |
| 5,031,557 | A | | 7/1991 | Farrier |
| 5,038,697 | A | | 8/1991 | Farrier |
| 5,235,925 | A | | 8/1993 | Farrier |
| 5,243,924 | A | | 9/1993 | Mann |
| 5,277,142 | A | | 1/1994 | Connor |
| 5,373,799 | A | | 12/1994 | Green |
| 5,392,726 | A | | 2/1995 | Benze |
| 5,515,801 | A | | 5/1996 | Fortin et al. |
| 5,517,940 | A | | 5/1996 | Beyer |
| 5,522,339 | A | | 6/1996 | Pelly |
| 5,540,170 | A | | 7/1996 | Purdy |
| 5,617,805 | A | | 4/1997 | Frigard |
| 5,642,682 | A | | 7/1997 | Pierce |
| 5,829,376 | A | | 11/1998 | Kostanski |
| 5,848,574 | A | | 12/1998 | Lande |

(Continued)

*Primary Examiner*—Andrew D. Wright
(74) *Attorney, Agent, or Firm*—Eric P. Schellin

(57) ABSTRACT

A trimaran having a hull and outrigger pontoons on each side of the hull. The pontoon are laterally movable away and towards the hull. Each of the pontoons are secured to the hull by forward and aft link boxes. The link boxes are pivotally mounted to the port side and starboard side of the hull. Each of the link boxes are also pivotally secured to a pontoon. The forward and aft link boxes of each side are connected together by a linkage whereby the forward port side and starboard link boxes are arcuately rotated when the aft port side and starboard link boxes are arcuately rotated.

3 Claims, 5 Drawing Sheets

U.S. PATENT DOCUMENTS 5,904,111 A 5/1999 Frigard
5,947,045 A 9/1999 Pietro
6,000,355 A 12/1999 Hall
6,003,458 A 12/1999 Valliere
6,044,784 A 4/2000 Gee et al.
6,089,173 A 7/2000 Lande
6,178,913 B1 1/2001 Brignolio
6,298,802 B1 10/2001 Brignolio
2002/0033127 A1 * 3/2002 Barrett ..... 114/61.15

* cited by examiner

STABILIZED WATERCRAFT SUCH AS A TRIMARAN

Priority is based on the Provisional application Ser. No. 60/494,099 filed Aug. 12, 2003.

TECHNICAL FIELD

This invention relates to a trimaran and more particularly to a trimaran having extendible and retractable stabilizing outriggers, i.e. pontoons.

BACKGROUND ART

Sailboats use wind to move forward in the water. As such, a sailboat must balance the forces of air pressure on the sails against water pressure on the hull(s) to efficiently move the boat in a given direction. This balance, or stability, is achieved using a variety of methods and designs.

In the case of a single-hull sailboat, or monohull, stability is achieved primarily through the use of a ballasted keel which lowers the center of gravity. In lowering the center of gravity, the righting-moment on a monohull is located between the center of gravity and the center of buoyancy on the hull. To support the weight of the ballast, the hull of a monohull is made wider which also increases stability.

In the case of a multi-hull sailboat, such as a catamaran or trimaran, stability is achieved primarily through extending the distance between the two hulls of a catamaran and/or the three hulls of a trimaran. A multihull therefore does not make use of a ballasted keel. The stability of a multihull is entirely dependent on the boat's overall width (beam) and the shape of the hulls.

While multihulls achieve the goal of sustaining sufficient stability under normal conditions of use, their respective width make them difficult and costly to transport and store. Highway rules make transporting a trimaran wider then 8'6" via a trailer unfeasible. The hull sizes for these watercrafts also tend to increase their manufacturing costs and hence, a greater cost to the consumer.

Boats having relatively narrow hulls and including features to enhance stability have heretofore been known. Typical prior art related to such boats is shown in U.S. Pat. Nos. 4,954,357; 5,647,294; 5,682,831; 5,642,682; 5,515,801; 5,771,715; 4,664,049; 4,512,275; 4,562,785; 4,730,570 and 5,174,233. Boats having narrow central hulls are particularly unstable; however, such boats are normally relatively easy to transport and relatively light in weight. Rigid or fixed laterally-mounted stabilizers for watercraft are known in the art, but such rigs are difficult to transport over land and to store when not in use. Accordingly, it is an object of the present invention to provide a watercraft having stabilizers which are selectively extendible and retractable relative to the hull of the watercraft.

Another object of the invention is to provide a watercraft having selectively adjustable elongated floatation members which provide lateral (side to side) stability while at the same time proving longitudinal (fore to aft) stability.

SUMMARY OF THE INVENTION

The trimaran achieves stability from two outrigger pontoons at each side of the main hull. The monohulls have the disadvantage of not only being heavier because of the weight of the ballast but has only one large hull that is harder to push through the water. The lighter un-ballasted trimaran with three narrow hulls has less resistance through the water. In addition, the trimaran has more stability and can carry more sail area per pound of displacement.

The inherent disadvantage of the trimaran is a beam roughly ⅔ the length. A 27' trimaran would therefore be 18' wide. Over the years numerous devices have been developed to reduce the beam for transporting the boat on a trailer or for marina berthing in a slip narrower then the fully-extended beam. The most common way to reduce the beam for trailering is to fold the outriggers down. Folding the outriggers down can be done in the water however; It is not suitable to leave the boat in the water for an extended time with the outriggers folded down. Yet another design involves swinging the outriggers aft and into the side of main hull to reduce the beam enough for marina storage. Unfortunately, swinging the outriggers aft can result in numerous disadvantages. In swinging the outriggers aft, the overall length increases which changes the fore and aft pitch of the boat, affecting stability.

The system that the inventor has developed is a link box that is half the length of the beam reduction for each side. When the link box rotates about 180 degrees the outrigger is moved inward the required amount. For example, a trimaran that is 27' long is 18' wide. The ink box is 28½" long on each side of the boat. When the link boxes are rotated about 180 degrees, the outriggers turn a semicircular motion horizontally to give the trimaran a new beam of 8'6".

While the concept to reduce beam is rather straight forward, it is complicated in execution. There are two sets of cross arms that join the outriggers to the main hull. Link boxes are part of the cross arms. At the front cross arm the outrigger deck is 30" wide and 15" thick vertically. The link box is 28½" wide and 15" tall at the outrigger and 20" tall at the main hull. The link box approximates a trapezoid. In reality, the link box is faired to reduce sea water pounding on the bottom and flat on the top as a walkway. Between the fore and aft cross arms, the outrigger is cut away so that it does not interfere with the bridge deck of the main hull when folded in. The main hull is 8'6" wide and has attachment points for the link, box at the outside edge and 20" apart vertically.

The link box is 28½" wide and 9" to 16" thick and is also a trapezoidal 15" in diameter with a fared underside and flat top. At the main hull the attachment points are at the side of the hull and 16" apart vertically.

When the link boxes rotate they tuck into recesses in the main hull. When this is done to both sides, the overall beam of the boat is reduced to 8'6".

To keep the link boxes rotating in unison there in a shelf connected to a pivot on each box, 9" aft of the main connections. As the boxes rotate the shelf also moves first going out, then forward, finally back in, 18" further forward than where it started before going back in. The rear of the link boxes curve down so that they act as a cam allowing the shelf to fold down as the link boxes rotate. Conversely, the rotation of the link boxes let the shelf on the outriggers move out. The shelf offers easy movement around the cabin when the trimaran is in sailing trim with an 18' beam. When hanging down the shelves partially fill in the gap between the underside of the main deck and the top of the outrigger deck.

The complication in design is to get clearance for the link boxes to rotate simultaneously into the main hull and the outriggers. The lower part of the cross arm on the main hull has to be designed strong and at the same time faired to prevent a water trap.

The link boxes have several important functions. The top and bottom of the boxes take the tension and compressive loads to support the outriggers. The existing invention involves a stainless steel strap bolted to the top and bottom of the link boxes. The stainless steel strap of the link box match with stainless steel straps on the outrigger and main hull forming the cross arm. The pivots are stainless steel vertical bolts. The wall between the top and bottom take the shearing loads. The box itself takes the torsion loads as the outrigger moves from out to in and back again. At the same time the boxes are fared to prevent sea water from slamming against the structure and negatively affecting the speed of the boat. The back of the box curves down 9" aft of the pivots. The position 9" aft of the pivot is where the shelf is attached.

To keep the link boxes pivoting in unison, a link arm is attached to both boxes 9" aft of the pivots. This link arm also doubles as a horizontal shelf situated outward from the cabin side when the outriggers are fully extended. As the boxes rotate about 180 degrees, a new part of the box that supports the shelf comes into play. With the back of the box curved down the shelf can now fold down when the boxes are in.

The cross arm and link connextion at the outrigger are straight forward. At the main hull, the top pivot to the link of the cross arm is easy. The bottom pivot is difficult at the main hull as the link box goes over the cross arm and the outrigger goes under. The cross arm needs to be held up and fixed fore and aft at the pivot. The recess that the link box goes into must not b a sea water trap.

BRIEF DESCRIPTION OF DRAWINGS

The above mentioned, and other, features and advantages of the invention will become more clearly understood from the following description of the invention read together with the drawings in which.

DETAILED DESCRIPTION OF THE INVENTION

Figure 1:
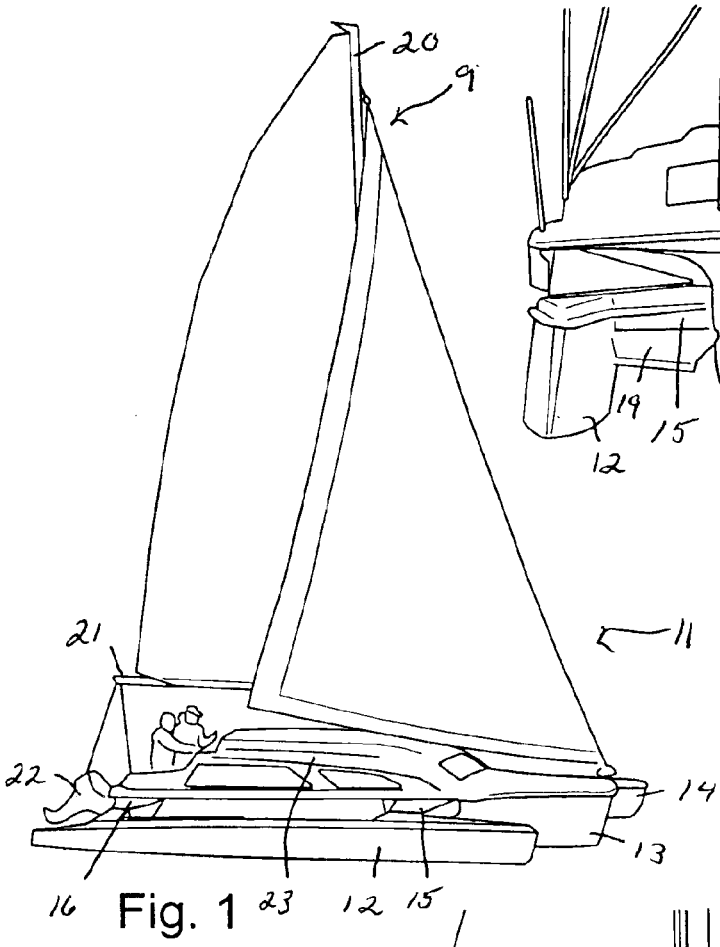
FIG. 1 is a side elevation of the trimaran of the invention with the outrigger pontoons in position for sailing and fully rigged.

FIG. 1 shows a perspective view of the trimaran, generally, 11 fully rigged with the outrigger starboard pontoon 12 on one side of the main hull 13 and a port side pontoon 14 on the opposite side of the main hull 13. The outrigger starboard pontoon 12 is connected to the main hull 13 by a forward rotatable link box 15 and at the aft of the main hull 13 by aft rotatable link box 16, both of which act as connectors between the sides of hull 13 and their respective outrigger pontoons 12 and 14. A like structure exists at the opposite side, i.e., port side, of the main hull 13.

The trimaran 11 is fitted with conventional rigging 9, conventionally and suitably mounted on a vertical mast 20. The mast 20 has a conventional boom 21. The trimaran 11 as depicted is seen to have an outboard motor 22 shown in a swung up position, i.e., out of the way in an unutilizable position. The trimaran is depicted with a conventional cabin 23.

While more will be taught about the link boxes 15 and 16 and their respective functions, at this juncture it is pointed out that the upwardly facing surfaces define an essentially cam whereby the thickness of the link boxes progressively varies so that its thinnest is presented when in one position closest to the outermost side of the hull 13 and the thickest portion is presented at the same locale when the pontoon is in an outrigger position.

It is also pointed out that each of the respective rotatable circular link boxes are pivotally secured between respective vertical pin points on the hull 13 and respective inwardly depicted projections 19, fore and aft on each of the pontoons 12 and 14. Said projections 19 acting together with their respective link boxes 15 or 16 as part of the outrigging of the said pontoons.

Figure 2:
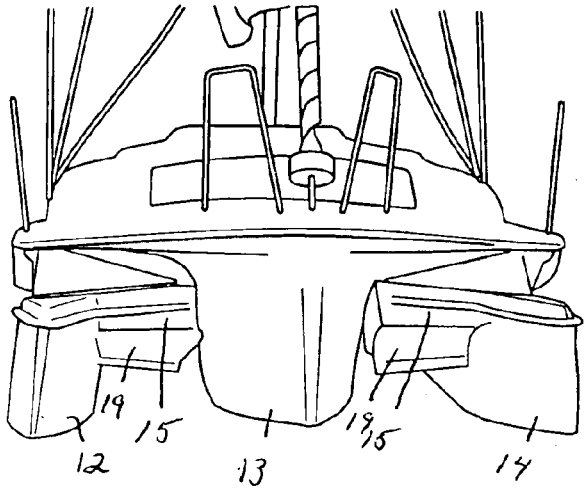
FIG. 2 is a frontal view of the trimaran with the outrigger pontoon in a non-extended condition as seen out of the water.

From FIG. 2, the pontoon 12 is shown to be in a withdrawn condition laterally to the main hull 13 with the forward link box 15 shown in an inwardly pivoted condition, shown to be in an overlying condition of outrigger projection 19. Note that the thickest part of link box 15 is facing outwardly. The same positions are attendant the aft link boxes 16 and projections 19. Note the end view of a shelf 24 which is positioned downwardly in FIG. 2, additional information in connection therewith will be provided hereinafter.

Figure 3:
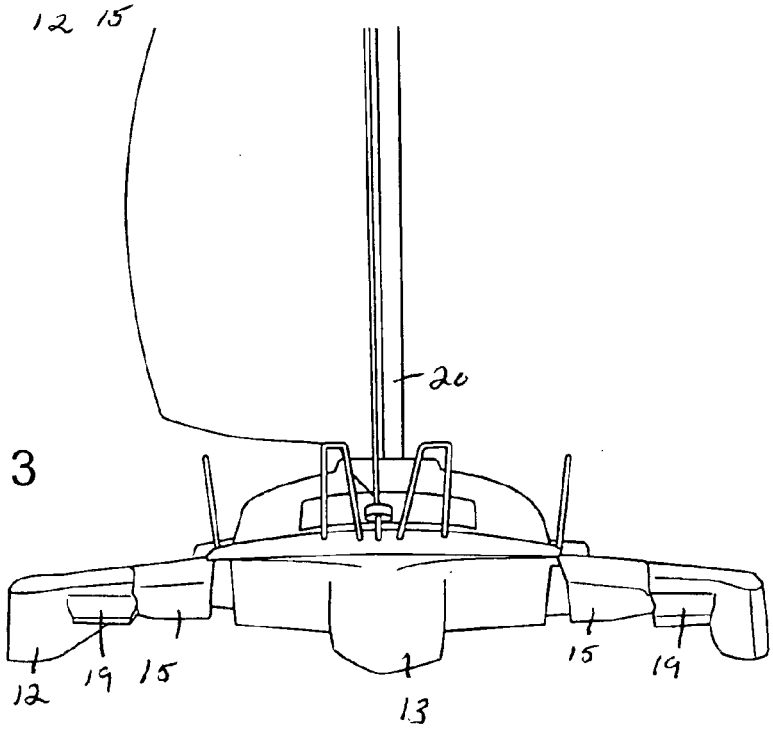
FIG. 3 is, substantially, the view of FIG. 2 with the outrigger pontoon in an extended condition.

In FIG. 3, the fully rigged trimaran is a front view. The starboard pontoon 12 is shown in a laterally extended condition with the link box 15 outwardly pivoted whereby the pontoon 12 is at its outermost reach to thereby gain the utmost stability. The port side is similarly depicted. Note shelves 24 which are shown in an essentially horizontal position and overlie a portion of upwardly facing cam surfaces of link boxes 15 and 16.

The said shelves 24 are pivotally secured to the thickest end of the respective link boxes by a short linkage with essentially a universal joint whereby each shelf acts as an elongated linkage between the fore and aft link boxes 15 and 16, on each side of the trimaran so that the fore and aft link boxes on a given side will act in unison. As stated heretofore, the shelf 24 rests essentially horizontally on the cam surface of the fore and aft link boxes.

Figure 4:
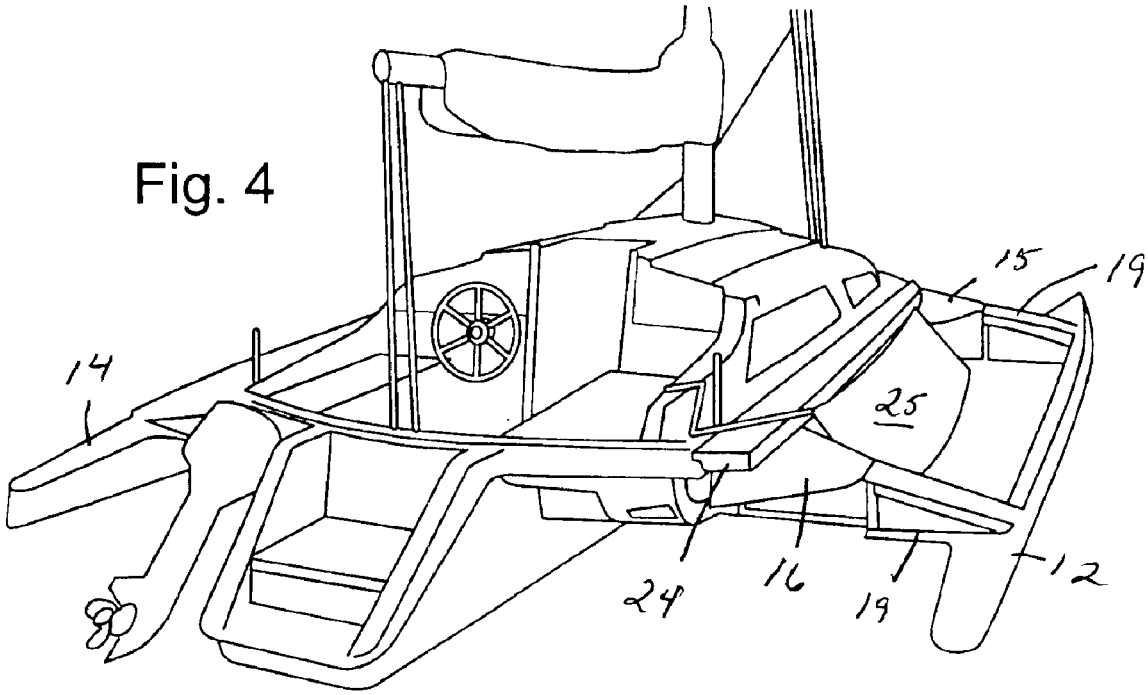
FIG. 4 is an aft perspective view of the trimaran showing the outrigger pontoons in an extended position.

FIG. 4 is a perspective partial view of the trimaran 11 with the starboard pontoon 12 depicted in a laterally extending position with a clear view of aft pivotable link box 16 and forward link box 15 are seen extending towards projections 19 to which they are pivotally secured. It will be noted that the space defined between the outer edge of the shelf 24 and the pontoon 12 is breached with a net 25 secured there between to catch items that without the net could fall into the water. The net 25 naturally folds into a plurality of horizontal folds as the starboard pontoon 12 moves laterally in the direction of the hull 13 to a collapsed position.

As the support and strength imparting brackets as seen or will be seen in connection with the various link boxes 15 and 16 have an important role to play in the present invention, more information will be provided in connection therewith hereinafter.

Figure 5:
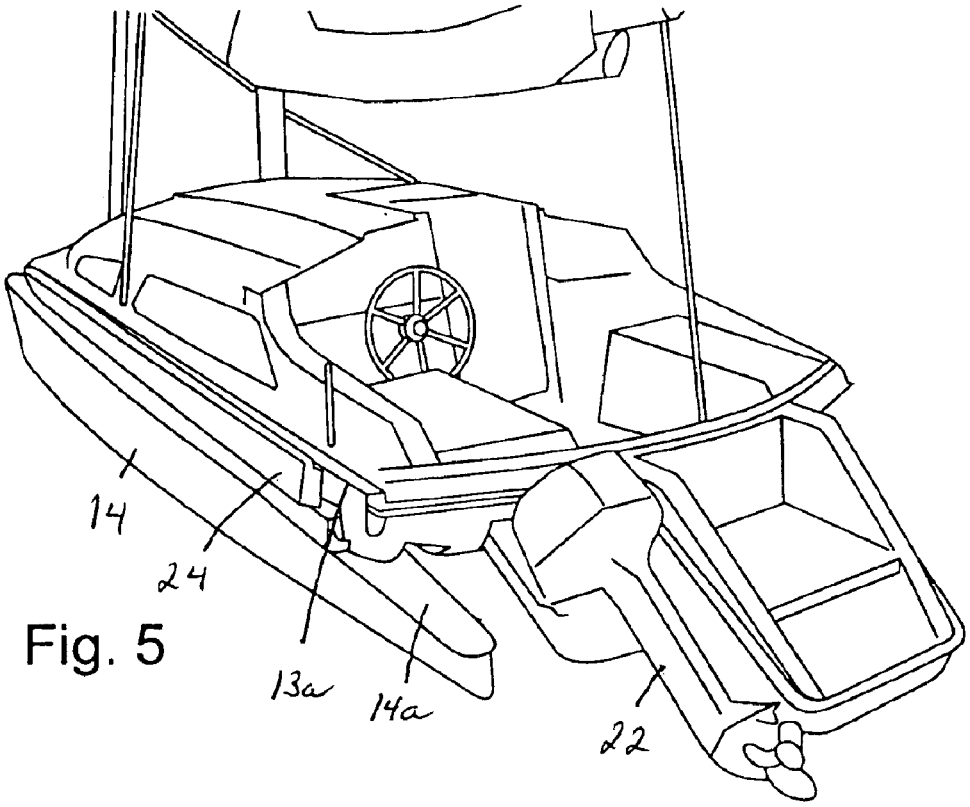
FIG. 5 is an aft perspective view of the trimaran with the outrigger pontoons in a non-extended position.

FIG. 5 shows the laterally withdrawn pontoon 14. Note therefrom the positioning of the shelf 24 shown to be essentially vertical and has filled the gap, that otherwise would be present, between the upper leading edge 13*a* of the hull 13 and the top surface 14*a* of pontoon 14.

In the configuration of the trimaran shown by FIG. 4, the vessel has an approximate 18 foot beam. In the configuration of the trimaran shown by FIG. 5 the beam is only 8 feet 6 inches which is eminently acceptable for highway trailering.

Figure 7:
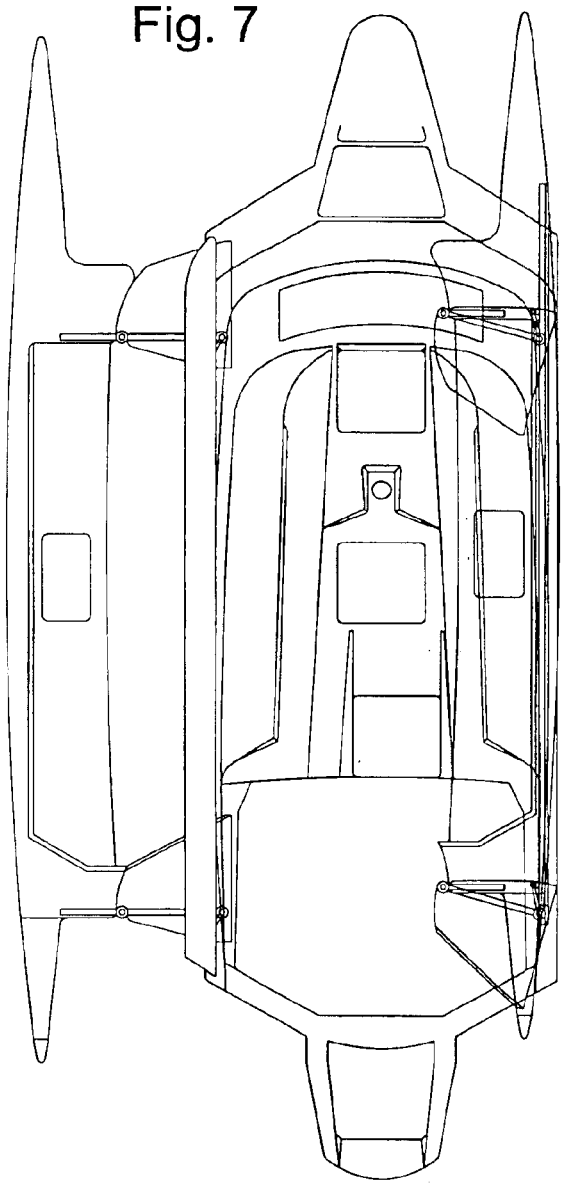
FIG. 7 shows the parta of FIG. 6 in an attached position at the port side of the main hull and to the right of the main hull the starboard pontoon is shown retracted under the main hull as if the latter was transparent.
Figure 6:
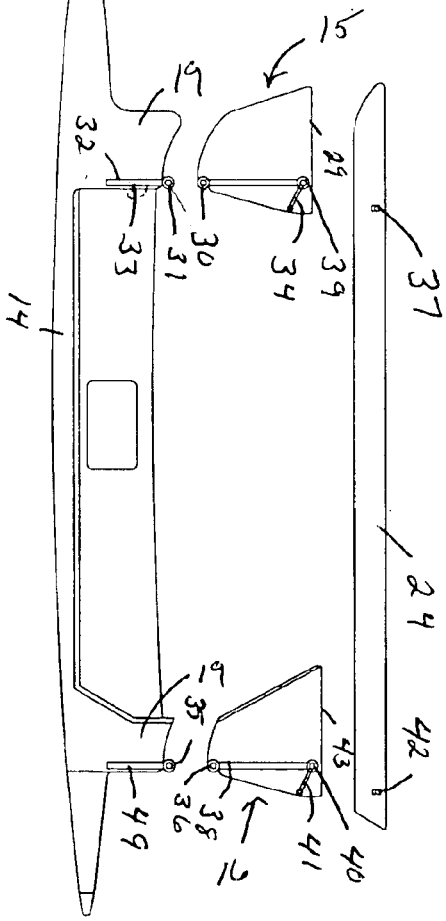
FIG. 6 is an exploded view of the important parts of the means for extending and folding of pontoon.

FIGS. 6 and 7 should be viewed together. FIG. 6 shows the operable components as shown in an exploded fashion. The pontoon 14 shown is on the port side. Forwardly, the pontoon 14 is seen outfitted with projections 19 both fore and aft. The foward projection 19 is fortified with a strong cross-arm 32 ending in an eyelet 31 to which link box 15 is pivotally 15 attached through a bolt 30 secured to strong bracket 28 which is secured to link box 15 from arcuate end to an opposite essentially straight edge 29. A short lever 34 is attached to a pivot point 39, the latter is pivotally attached to the hull 13 at an outer edge 50 of a recess 51 on the side of the hull detailed to accept the major portion of the link boxes 15 and 16 when the pontoon 14 is in the withdrawn position. The shelf 24 has a pivot point 37 detailed to accept the outer end of lever 34 in a pivoting and hingeing manner.

The aft link box 16 of pontoon 14 is detailed in a similar manner wherein projection 19 is fitted with a strong bracket 49 which terminates in a bearing eyelet 35 which is pivotally attached at 36 to one end of a strong bracket 38. The other end is attached as heretofore with regard to box link 15 to a bearing eyelet 40 to which is attached a lever 41. The end of lever 41 is universally attached to pivot point 42 at the aft end of the shelf 24. The shelf acts as a linkage to insure that link boxes 15 act in unison.

In FIG. 7, the pontoon 14 on the port side is shown assembled with the components shown in FIG. 6. The bearing 40 is fitted with a crank handle, not shown, detailed to provide a mechanical advantage to rotate clockwise link box 16; to thereby secure arcuately clockwise, said link box 16 towards and into a recess 51 in hull 13 while at the same time shelf 24 acting as aa linkage acts on the pivot point 39 to move link box 15 clockwise into a similar recess 51 in the fore part of the port side of the hull. The concomitant movement of the clockwise multi-degree movement of the link boxes 15 and 16 laterally inwardly move the pontoon somewhat forwardly of the hull and back thereby completing the designed withdraw or lateral collapse. A similar path is described in reverse when the pontoon is moved to its outrigged position.

On the starboard side of the hull one can see the lateral inward positioning of the hull and respective link boxes 15 and 16 in a manner as if that side of the trimaran was transparent so the retracted components can be seen at rest.

FIGS. 8 through 13 are schematic renditions designed to show in greater clarity the ingenious function of the component parts to effect the smooth lateral movement of the pontoons 12 and 14. These drawings should be viewed in seriatum to show the operation in sequence. Each of the views is depicted as a top view. Starting with FIG. 8 one can see that the pontoon 14 is in its furthermost outrigged reach. The bold arrows depicted are merely for the purpose of illustrating the extent of the lateral movement of the pontoon to achieve essentially a complete withdrawal as seen in the final rendition of FIG. 13. Note the link box 15 of the pontoon 12 and link box 16 of the aft portion of the pontoon. Each link box 15 and 16 describe from a top view a sort of trapezoidal housing configuration. Link box 16 is connected to the pontoon at 30 by a vertical pivot 31 and is secured to the pontoon by a strong metal strap 32. Likewise link box 16 is secured to the pontoon 14 by a vertical pin 36 and is secured to the aft portion by a metal strap 49. An elongated metal strap 38 is secured to the surface of link box 16 and terminates substantially near the edge 43 with a vertical pivot point 40 to which is pivotally attached a relatively short lever 41 ending in a vertically extending pivot point 42 ending in a vertically extending pivot point 40 which is attached near the top edge portion of the shelf 24. Similarly, link box 16 has a metal strap 38 secured to the link box 16 which also terminates near the edge 43 with a vertical pivot point 40 to which is attached a relatively short lever 41 terminating in a vertically extending pivot point 42. Pivot 40 has a crank handle having a mechanical advantage whereby the link box 16 may be rotated clockwise through an angle into the aft recess 51 on the port side of hull 13.

Figure 9:
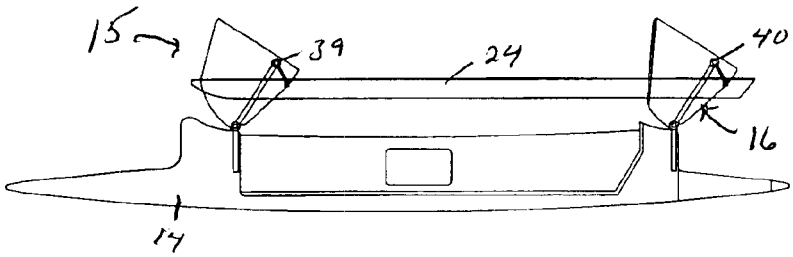
FIG. 9 depicts a partial withdrawal.
Figure 8:
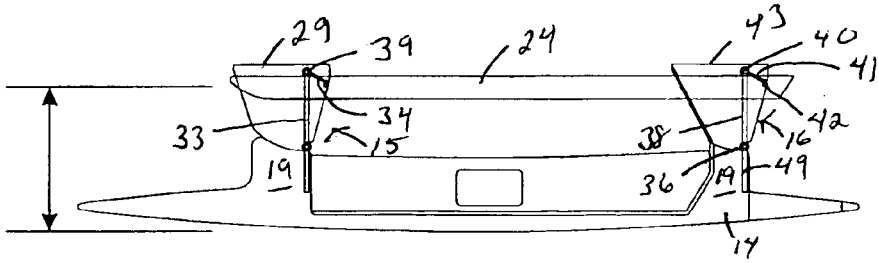
FIG. 8 shows a top partial schematic view of the fully extended pontoon with the arrows depicting the full dimension of the distance of the withdrawal.
Figure 14:
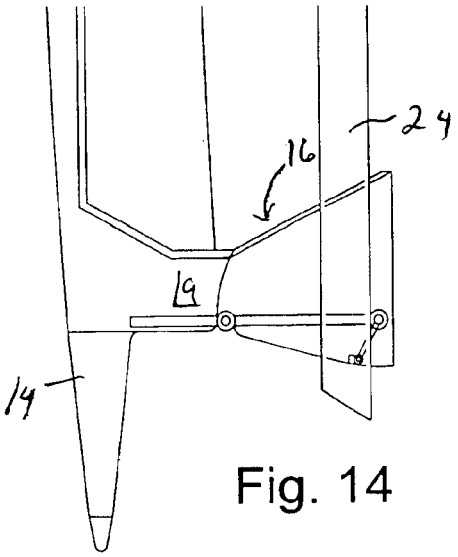
FIG. 14 is a partial top view of link box 16 with the pontoon in an outreach condition.
Figure 15:
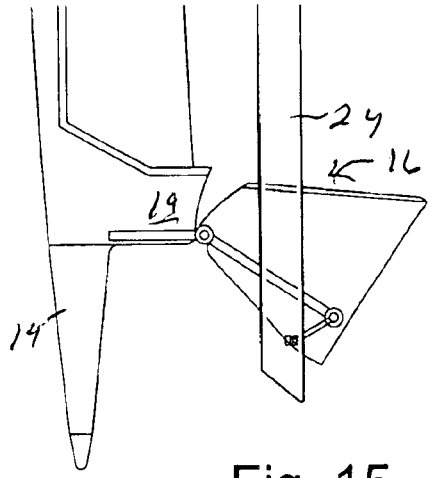
FIG. 15 is like FIG. 14 with the outreach less severe.
Figure 16:
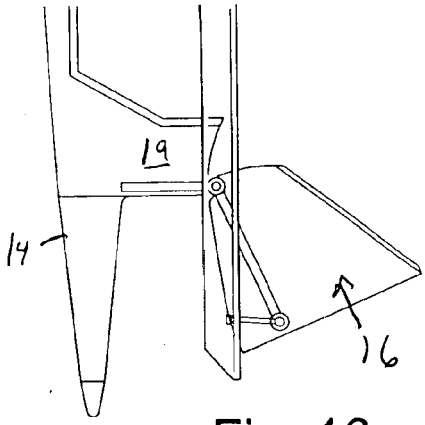
FIG. 16 is like FIG. 15 with the pontoon is further withdrawn.
Figure 17:
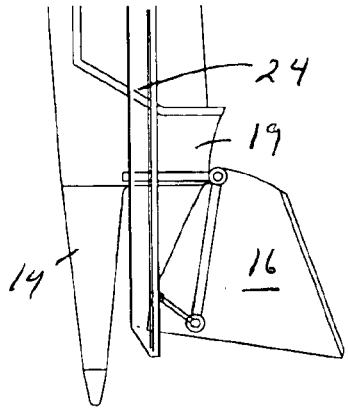
FIG. 17 shows the pontoon more withdrawn.
Figure 18:
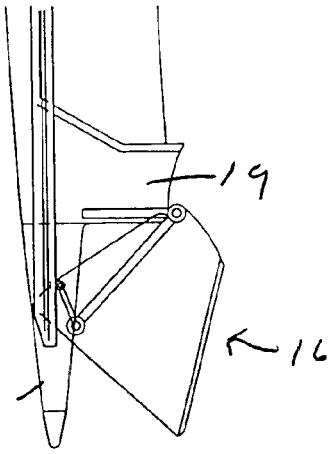
FIG. 18 the pontoon is even more withdrawn.
Figure 19:
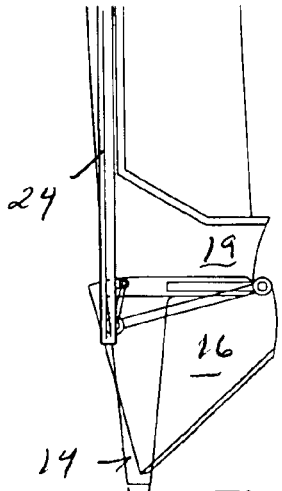
FIG. 19 shows the pontoon completely withdrawn.

FIG. 9 depicts the same structure as in FIG. 8 but depicts a small angular clockwise motion of each link box 15 and 16 moving about their respective pivot points 39 and 40 with the pontoon also describing a relatively small foreward linear motion.

As stated the main hull has suitable recesses or cavities built there into at their respective sides to accommodate the laterally extending link boxes 15 and 16. These recesses or cavities are relatively simple to fabricate as the main hull is made of epoxy and fiber glass.

Figure 13:
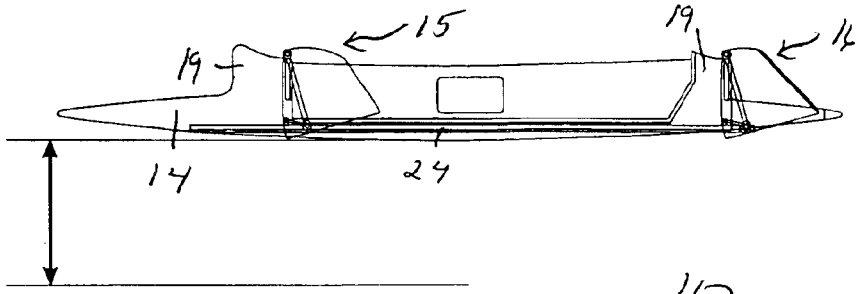
FIG. 13 shows the completion of the withdrawal.
Figure 12:
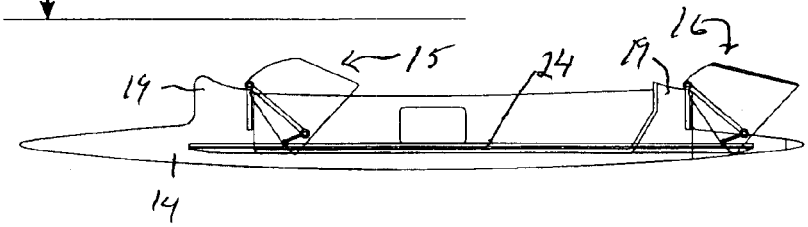
FIG. 12 depicts a continuation of the withdrawal.
Figure 11:
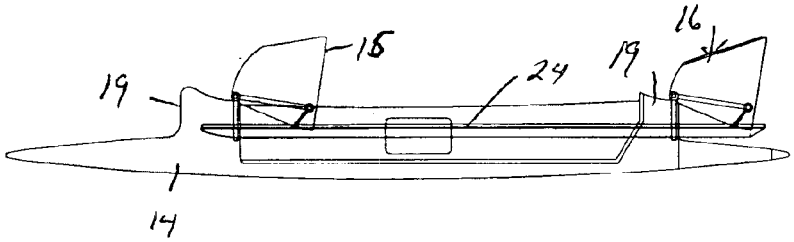
FIG. 11 depicts a still further withdrawal.
Figure 10:
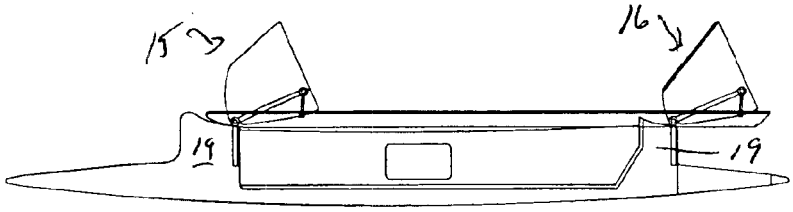
FIG. 10 depicts a further withdrawal.

In FIG. 10 one can easily observe a still further motion of link boxes 15 and 16 in a further follow through. Then, FIG. 11 shows a still further follow through, but in this position shelf 24 is in a stage of hinged arcuate movement from a near horizontal position as in FIG. 8 to the angular result while acting as a linkage means to synchronize movement between link box 16 and link box 15 which is driven by the former. In FIG. 12, the link box 15 and link box 16 have almost achieved their complete clockwise arcuate motion and the shelf 24 is more vertical. In the final depiction the respective link boxes 15 and 16 are in their most extreme position with link box 16 positioned in a recess 511 located in the side of the hull 13. Similarly, a recess 51 is provided in the aft portion of the side of hull 13. In its final position, as depicted in FIG. 13 it will be noted that the arrows depicted illustrates the extent of the withdrawal. At the same time the pontoon has returned to its same fore-aft position as when the pontoon was in its extended position relative to the main hull 13.

FIG. 14 through 19 should also be viewed in seriaturn as FIGS. 8–13 and are the same views but only of the aft position of the portion showing link box 16 and angle enlarged for purposes of achieving even greater clarity. The reference numerals are the same as the previously recited discussion pertains, especially with regard to FIGS. 8 to 13.

What I claim is:

1. A trimaran comprising a main hull and a first pontoon disposed on the port side of said main hull and a second pontoon disposed on the starboard side of said main hull;

a) said first and second pontoons each having two laterally spaced first and second projections;

b) the two projections of said first pontoon extending in the direction of said port side of said hull;

c) the two projections of said second pontoon extending in the direction of said starboard side of said hull;

d) a first forward port side link box, said forward port side link box being pivotally connected at one side to an end of said port side first projection, said first forward port side link box also being pivotally connected at the opposite side of the first forward port side link box and pivotally to a forward portion of the hull;

e) a second aft port side link box, said aft port side link box being pivotally connected at one side to an end of said port side second projection, said second aft port side link box also being pivotally connected at the opposite side of the second aft port side link box and pivotally to an aft portion of the hull;

f) drive means for rotating clockwise said second aft port side link box about a major arc;

g) a mechanical linkage means, said linkage means operatively connecting said second aft port side link box to said first port side link box whereby the first port side link box rotates clockwise through a major arc in unison when said aft port side link box is rotated;

h) said hull having an aft port side recess adapted and constructed to receive said aft port side link box when said aft port side link box is rotated clockwise;

i) said hull having a forward port side recess adapted and constructed to receive said forward port side link box when said forward port side link box is rotated clockwise;

j) each of said link boxes adapted and constructed to over lie each of said port side projections when said port side pontoon is in a withdrawn recessed position;

k) a first forward starboard link box, said forward starboard link box being pivotally connected at one side to end of said starboard first projection, said first forward starboard link box also being pivotally connected at the opposite side of the forward starboard link box and pivotally to a forward portion of the hull;

l) a second aft starboard link box, said aft starboard link box being pivotally connected at one side to an end of said starboard second projection, said all starboard link box also being pivotally at the opposite side of the second aft starboard link box and pivotally to an aft portion of the hull;

m) drive means for rotating counter clock wise said second all starboard link box about a major arc;

n) a mechanical linkage means, said linkage means operatively connecting said second aft starboard link box to said first starboard link box whereby the first starboard link box rotates counter clockwise through a major arc in unison when said aft starboard link box is rotated;

o) said hull having an aft starboard recess adapted and constructed to receive said aft starboard link box when said aft starboard link box is rotated counter clockwise;

p) said hull having a forward starboard recess adapted and constructed to receive said forward starboard link box when said forward starboard link box is rotated counter clockwise;

q) each of said link boxes adapted and constructed to over lie each of said starboard projections when said starboard is in a withdrawn recessed position.

2. The trimaran according to claim 1 wherein the top view of each of said link boxes present a substantially trapezoidal configuration.

3. The trimaran according to claim 1 wherein each of the link boxes have a vertical dimension which is highest at the point in contact with hull and lowest at the point with the said projections of said pontoons when said pontoons are in extended positions.

* * * * *